United States Patent [19]

Frankenfeld et al.

[11] Patent Number: 5,076,946

[45] Date of Patent: Dec. 31, 1991

[54] ALKYLAMINE SUBSTITUTED BENZOTRIAZOLE CONTAINING LUBRICANTS HAVING IMPROVED OXIDATION STABILITY AND RUST INHIBITION (PNE-530)

[75] Inventors: John W. Frankenfeld, Hoboken, N.J.; Keith U. Ingold, Ottawa, Canada

[73] Assignee: Exxon Research and Engineering Company, Florham Park, N.J.

[21] Appl. No.: 502,583

[22] Filed: Mar. 30, 1990

[51] Int. Cl.[5] ..... C10M 133/44

[52] U.S. Cl. ..... 252/50; 548/257

[58] Field of Search ..... 252/50; 548/257

[56] References Cited

U.S. PATENT DOCUMENTS

| | | | |
|---|---|---|---|
| 3,413,227 | 11/1968 | Howard et al. | 252/50 |
| 3,697,427 | 10/1972 | Byford et al. | 252/49.8 |
| 3,790,481 | 2/1974 | Byford et al. | 252/49.8 |
| 4,153,565 | 5/1979 | Braid et al. | 548/257 |
| 4,197,210 | 4/1980 | Bridger | 548/257 |
| 4,268,610 | 5/1981 | Roos | 427/98 |
| 4,376,635 | 3/1983 | Sung | 548/257 |
| 4,581,150 | 4/1986 | Harodysky et al. | 252/50 |

FOREIGN PATENT DOCUMENTS

| | | | |
|---|---|---|---|
| 1061904 | 3/1967 | United Kingdom . | |
| 1514359 | 6/1978 | United Kingdom . | |
| 2136797 | 9/1984 | United Kingdom | 252/50 |

OTHER PUBLICATIONS

Sherwin Williams Technical Bulletin 143, Benzotriazole, Tolyltriazole CA 95: 159907j.
CA 86: 93000p.
CA 67: 73608x.

*Primary Examiner*—Margaret B. Medley
*Assistant Examiner*—E. McAvoy
*Attorney, Agent, or Firm*—John W. Ditsler

[57] ABSTRACT

The addition of certain alkylamine substituted benzotriazole compounds to a lubricant imparts improved oxidation stability and rust inhibition to the lubricant.

16 Claims, No Drawings

ALKYLAMINE SUBSTITUTED BENZOTRIAZOLE CONTAINING LUBRICANTS HAVING IMPROVED OXIDATION STABILITY AND RUST INHIBITION (PNE-530)

BACKGROUND OF THE INVENTION

1. Field of the Invention

This invention concerns lubricating compositions having improved oxidation stability due to the presence of an alkylamine substituted benzotriazole.

2. Description of Related Art

Oxidation stability is an important requirement for all lubricants, including automotive lubricating oils, industrial oils, and greases. The major cause of oxidative instability is the auto-oxidative breakdown of hydrocarbons in the lubricants and the concomitant formation of acids and other undesirable oxygenated species, including sludge. Auto-oxidative breakdown is strongly catalyzed by traces of metal ions (especially copper and iron) which become solubilized when the lubricant contacts a metal surface. One way to control auto-oxidation is to add one or more metal deactivators to the lubricant. In general, these deactivators prevent such undesirable catalytic reactions from occurring in two different ways: The metal deactivators form impervious films on the metal surface, thereby preventing dissolution of the metal ions (these are called "film forming metal passivators"), or the metal deactivators form complexes with solublized metal ions, thus rendering them inactive as catalysts (these are called "soluble metal deactivators").

Certain benzotriazole derivatives are known metal deactivators of the film forming type. For example, U.S. Pat. No. 3,697,427 discloses the use of benzotriazole and certain alkyl benzotriazoles (e.g. methylene bis-benzotriazole) in synthetic lubricating compositions.

Similarly, U.S. Pat. No. 3,790,481 discloses a polyester lubricating base stock that contains, among other additives, a copper passivator selected from methylene bis benzotriazole, benzotriazole, alkyl benzotriazoles, and naphthotriazole.

U.K. Patent 1,514,359 discloses the use of certain bis-benzotriazoles in functional fluids wherein the benzotriazole moieties are connected by alkylene and cycloalkylene groups, carbonyl groups, a sulphonyl group, oxygen, or sulfur atoms. The benzotriazole moieties also have dialkylamino methyl groups attached.

U.K. Patent 1,061,904 discloses the use of certain substituted benzoimidazoles and benzotriazoles as metal deactivators in lubricating compositions and functional fluids.

However, none of these patents (the disclosures all of which are incorporated herein by reference) disclose the particular alkylamine substituted benzotriazole containing lubricant compositions described hereafter.

SUMMARY OF THE INVENTION

This invention concerns lubricant compositions containing an oxidation reducing and rust inhibiting amount of certain benzotriazoles. More specifically, we have discovered that the oxidation reducing and rust inhibiting capability of a lubricant can be improved when the lubricant contains a minor amount of an additive having the structure shown below:

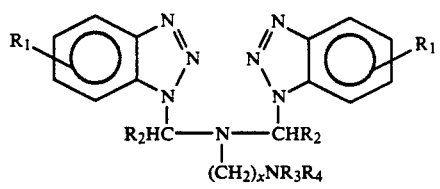

(I)

wherein $R_1$–$R_4$ may be the same or different and are hydrogen or an alkyl group, and x is an integer ranging from 1 to 10.

Preferably x is 2 or 3, most preferably 2.

DETAILED DESCRIPTION OF THE INVENTION

The benzotriazole additives of this invention have structure (I) shown above where $R_1$, $R_2$, $R_3$, and $R_4$ ($R_1$–$R_4$) are defined as above. Although the number of carbon atoms in the alkyl groups of $R_1$–$R_4$ can vary broadly, the alkyl groups will generally contain from 1 to 20, preferably from 1–10, more preferably from 1 to 4, and most preferably from 1 to 3, carbon atoms. In addition, the alkyl groups in $R_1$–$R_4$ may be straight or branched, but a straight carbon chain is preferred. Preferably, $R_1$ is hydrogen or an alkyl group having from 1 to 4 (preferably from 1 to 3) carbon atoms; $R_2$ is hydrogen; and $R_3$ and $R_4$ is an alkyl group having from 1 to 4 (preferably from 1 to 3) carbon atoms. Most preferably, $R_1$ is hydrogen or $CH_3$; $R_2$ is hydrogen; and $R_3$ and $R_4$ are each $CH_3$. If $R_1$ is an alkyl group, the group should most preferably be in the 5 numbered position according to the structure shown below (which is the benzotriazole portion of structure (I)):

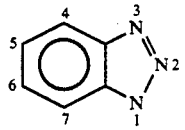

An alkyl group in either the 4 or 7 numbered positions is less desirable because the effectiveness of the additive for oxidation stability will be reduced.

Compounds having structure (I) can be obtained, for example, by reacting benzotriazole (or a substituted benzotriazole), formaldehyde (or an alkyl aldehyde), and an amine in an aqueous medium or in various solvents (e.g. ethanol, methanol, or benzene). Such preparation techniques as well known in the art and are described, for example, in U.K. Patent 1,061,904.

In general, the lubricants of this invention will comprise a major amount of a lubricating oil basestock (or base oil or an oil of lubricating viscosity) and a minor amount of the aromatic substituted benzotriazole additives having structure (I). If desired, other conventional lubricant additives may be present as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof): alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, di-ethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating base oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The amount of benzotriazole added to the lubricant compositions of this invention need only be an amount sufficient to increase the auto-oxidative stability (and rust inhibition) of the lubricant relative that obtained in the absence of the additive. In general, the amount of additive can range from about 0.01 up to about 5 weight% or more (based on the total weight of the composition), depending on the specific application of the lubricant. Typically, however, from about 0.01 to about 2 wt.% of the additive will be used to ensure solubility of the additive and for economic considerations. Preferably, the amount of additive used will range from about 0.01 to about 1.0, more preferably from about 0.02 to about 0.20, weight%.

Other additives may be present in the lubricant compositions of this invention as well, depending upon the intended use of the composition. Examples of other additives include ash-free detergents, dispersants, corrosion preventing agents, antioxidants, pour-point depressants, extreme pressure agents, viscosity improvers, colorants, antifoamers, and the like.

Lubricants containing the benzotriazole additives of this invention can be used in essentially any application requiring a lubricant having good oxidation stability and rust protection capability. Thus, as used herein, "lubricant" (or "lubricant composition") is meant to include automotive lubricating oils, industrial oils, greases, and the like. For example, the lubricant compositions of this invention can be used in the lubrication system of essentially any internal combustion engine, including automobile and truck engines, two-cycle engines, aviation piston engines, marine and railroad engines, and the like. Also contemplated are lubricants for gas-fired engines, alcohol (e.g. methanol) powered engines, stationary powered engines, turbines, and the like.

However, the lubricant compositions of this invention are particularly useful in industrial oils such as turbine oils, gear oils, compressor oils, hydraulic fluids, spindle oils, high speed lubricating oils, process oils, heat transfer oils, refrigeration oils, metalworking fluids, and the like.

This invention will be further understood by reference to the following examples which are not intended to restrict the scope of the claims. In the examples, various benzotriazole compounds (all antioxidants) were added to samples of a lubricating oil. Several different oxidation tests and a rust test were then performed on the samples to determine their oxidation reducing and rust inhibiting capability. Unless otherwise stated, the lubricating oil used in each example was a partially formulated lubricating oil consisting of a Solvent 150 Neutral base oil containing 0.04 wt.% of a rust inhibitor and 0.2 wt.% of a phenolic antioxidant. The benzotriazole compounds tested are shown below:

(II)

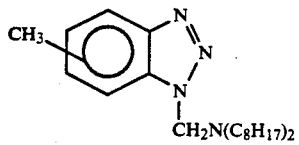

(III)

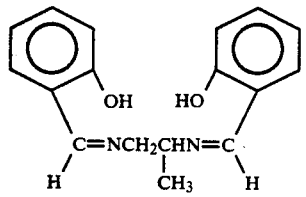

(IV)

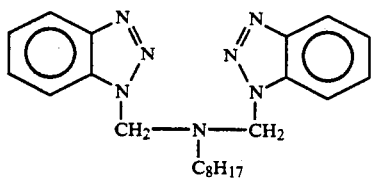

(V)

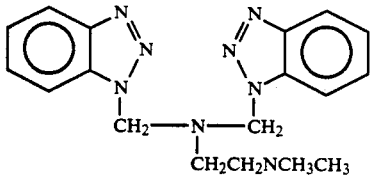

(VI)

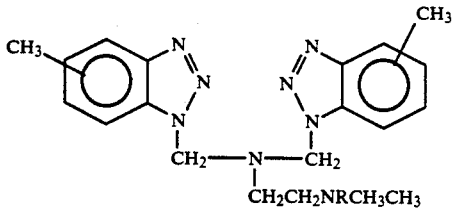

Compounds II (commercially available) and IV are film forming metal passivators, Compound III is a commercially available soluble metal deactivator, and Compounds V and VI are additives according to this invention.

In the following examples, one or more of the following tests were performed to determine the oxidation stability and rust inhibition of the various additives tested:

Modified ASTM D2440 Oxidation Test

This test measures the effectiveness of the additives to passivate a solid metal catalyst. In this test (which is a modification of ASTM Oxidation Test Method D2440), the oil is contacted with $O_2$ (flowing at 1 liter/hr) at 120° C. for 164 hours in the presence of a solid copper wire catalyst. The Total Acid Number (TAN) and the weight% sludge produced during the test was determined and the Total Oxidation Products (TOP) calculated using the following equation:

$$TOP = \frac{TAN}{3} + \text{weight \% sludge}$$

The TOP is a measure of the degree of oxidation—the lower the TOP, the more effective the additive is as an antioxidant. The amount of copper dissolved in the oil during the test was also measured to determine the metal passivating capacity of the additive. The less dissolved copper in the oil indicates better passivation.

CIGRE (IP 280) Oxidation Test

The CIGRE test measures the ability of an additive to deactivate soluble copper and iron. Film forming additives which are effective against solid metals in the D2440 test may not perform well in the CIGRE test. In this test, the test oil is oxidized at 120° C. for 164 hours in the presence of a soluble copper naphthenate catalyst, a soluble iron naphthenate catalyst, or a combination of the two as a catalyst. An oxygen flow rate of 1 liter/hr is maintained during the test. The TOP is calculated as in the D2440 test and has the same significance.

ASTM D943 Oxidation Test

ASTM D943 is another test used to measure the oxidation stability of industrial lubricants. In this test, the oil is oxidized in the presence of oxygen, water, and copper and iron wire catalysts at 95° C. The D943 life is the number of test hours required for the oil to reach a Total Acid Number of 2.0 mg KOH/g. The longer the life, the more stable the oil.

Staeger Oxidation Test

The Staeger test is yet another test used to determine the oxidation stability of industrial lubricants. In this test, the oil is oxidized at 110° C. in the presence of a copper metal plate while air passes over the surface of the oil. The oil "life" is the time required for a 0.2 unit increase in the neutralization number of the oil as determined by titration. A unit is equivalent to one mg of KOH/g of oil. The longer the "life", the more stable the oil.

ASTM D665 Rust Test

This test evaluates additives as inhibitors for iron and steel. In this test, a mixture of 100 ml of test oil and 30 ml of distilled water is stirred at a temperature of 60° C. with a cylindrical steel spindle immersed therein. After 24 hr, the test is terminated and the spindle rated visually for rust on a scale of 1.0 (0% rust) to 6.0 (100% rust).

EXAMPLE 1

Modified ASTM D2440 Tests on the Partially Formulated Oil

ASTM D2440 tests were performed on several samples of the partially formulated oil to which various benzotriazole compounds had been added. The concentration of each additive in the oil sample tested is shown in Table 1 (and in Tables 2–4 as well) as weight % based on weight of the oil. The results of these tests are shown in Table 1 below.

TABLE 1

| Run No. | Compound | Wt. % | TOP | Dissolved Cu, ppm |
|---|---|---|---|---|
| 1 | None | — | 3.0 | 19.5 |
| 2 | II | 0.08 | 0.8 | 1.7 |
| 3 | III | 0.07 | 0.04 | 30 |
| 4 | IV | 0.08 | 0.06 | <0.1 |
| 5 | V | 0.08 | 0.10 | 0.37 |
| 6 | VI | 0.08 | 0.09 | 0.74 |

The data in Table 1 show that Compound II is a moderately good antioxidant (TOP=0.8 wt%) and film former (dissolved copper=1.7 ppm). Compound III is a excellent antioxidant (TOP=0.04 wt.%) but not a good film former because it is apparently solubilizing metal ions (dissolved copper=30 ppm). Compounds IV, V, and VI are excellent antioxidants and film formers because the oils containing the compounds had low values for TOP and dissolved copper.

EXAMPLE 2

CIGRE Tests on the Partially Formulated Oil

CIGRE tests were performed on the same formulations tested in Example 1. The results of these tests are shown in Table 2 below.

TABLE 2

| Run No. | Compound | Wt. % | TOP (Wt. %) Cu | Fe | Cu + Fe |
|---|---|---|---|---|---|
| 7 | None | — | 2.1 | 2.4 | 4.0 |
| 8 | II | 0.08 | 2.2 | 2.3 | 5.1 |
| 9 | III | 0.07 | 0.18 | 3.2 | 2.2 |
| 10 | IV | 0.08 | 0.27 | 0.80 | 2.57 |
| 11 | V | 0.08 | 0.16 | 0.20 | 0.85 |
| 12 | VI | 0.08 | 0.16 | 0.18 | 1.66 |

The TOP data in Table 2 show that Compound II (a film former) is ineffective in deactivating soluble copper, soluble iron, and a combination of the two. The data also show that Compounds III and IV were effective in deactivating copper, but not iron or copper plus iron. However, Compounds V and VI were effective in deactivating all the catalysts tested (all TOP's below 2.0 wt.%). This indicates that Compounds V and VI are good soluble metal deactivators.

EXAMPLE 3

ASTM D943 and Staeger Tests on the Partially Formulated Oil

ASTM D943 and Staeger tests were performed on several formulations similar to those tested in Example 1. The results of these tests are shown in Table 3 below.

TABLE 3

| Run No. | Compound | Wt. % | D943 Life (Hr) | Staeger Life (Hr) |
|---|---|---|---|---|
| 13 | None | — | <840 | 410 |
| 14 | II | 0.08 | 1879 | 718 |
| 15 | V | 0.04 | 2215 | 916 |
| 16 | V | 0.08 | 2210 | 1120 |

The data in Table 3 show that the additives of this invention (as illustrated by Compound V) significantly improved the oxidation stability of the partially formulated base oil relative to that obtained using a commercially available antioxidant (Compound II), at even ½ the concentration.

EXAMPLE 4

ASTM D665 Rust Test on Solvent 150 Neutral Base Oil

ASTM D665 tests were performed on the Solvent 150 Neutral base oil (without the rust inhibitor and phenolic antioxidant) to which various benzotriazole compounds had been added. The results of these tests are shown in Table 4 below.

TABLE 4

| Run No. | Compound | Wt. % | Rust Evaluation Visual Rating | % Rust |
|---|---|---|---|---|
| 17 | None | — | 6.0 | 100 |
| 18 | II | 0.08 | 5.9 | 95 |
| 19 | Parabar-302(1) | 0.04 | 1.0 | 0 |
| 20 | IV | 0.08 | 5.9 | 95 |
| 21 | V | 0.05 | 1.0 | 0 |

(1)Parabar-302 is a benzotriazole free commercial rust inhibitor available from Exxon Chemical Company.

The data in Table 4 show that Compound II, which is a moderately good copper passivator (see Run No. 2 in Table 1), was ineffective in protecting iron. Compound IV was also ineffective. Compound V, however, was as effective in this test as Parabar-302, a standard rust inhibitor.

Thus, the data in Examples 1–4 show that the additives of this invention (namely structure I as illustrated by Compounds V and VI) are effective as film forming metal passivators and soluble metal deactivators, thereby providing the lubricant with excellent oxidation stability. These additives also protect iron and steel against rust.

What is claimed is:

1. A lubricant composition comprising a major amount of a lubricating base oil and a minor amount of an additive having the formula:

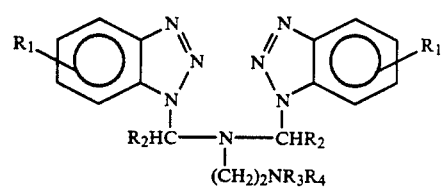

wherein $R_1$–$R_4$ may be the same or different and are hydrogen or an alkyl group.

2. The composition of claim 1 wherein the alkyl group in each of $R_1$ –$R_4$ contains from 1 to 20 carbon atoms.

3. The composition of claim 2 wherein the alkyl group in each of $R_1$–$R_4$ is straight chained.

4. The composition of claim 2 wherein at least one of $R_1$–$R_4$ is an alkyl group having from 1 to 4 carbon atoms.

5. The composition of claim 4 wherein at least one of $R_1$ –$R_4$ is an alkyl group having from 1 to 3 carbon atoms.

6. The composition of claim 5 wherein at least two of $R_1$ –$R_4$ is an alkyl group having from 1 to 3 carbon atoms.

7. The composition of claim 1 wherein from about 0.01 to about 5 wt.% of the additive is present in the composition.

8. A lubricant composition comprising a major amount of an oil of lubricating viscosity and from about 0.01 to about 5 wt.% of an additive having the formula:

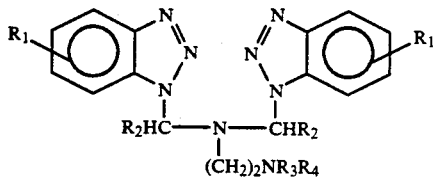

wherein $R_1$ is hydrogen or an alkyl group having from 1 to 3 carbon atoms, $R_2$ is hydrogen, and $R_3$ and $R_4$ are each 1 to 3 carbon atoms.

9. The composition of claim 8 wherein from about 0.01 to about 2 wt.% of the additive is present in the composition.

10. The composition of claim 9 wherein from about 0.01 to about 1 wt.% of the additive is present in the composition.

11. The composition of claim 9 wherein the alkyl group in $R_1$ is $CH_3$.

12. The composition of claim 11 wherein $R_3$ or $R_4$ is $CH_3$.

13. The composition of claim 11 wherein $R_3$ or $R_4$ are both $CH_3$.

14. The composition of claim 13 wherein from about 0.02 to about 0.2 wt.% of the additive is present in the composition.

15. The composition of claim 9 wherein $R_1$ is hydrogen and $R_3$ and $R_4$ are both $CH_3$.

16. The composition of claim 15 wherein from about 0.02 to about 0.2 wt.% of the additive is present in the composition.

* * * * *